US009044633B2

(12) United States Patent
Pesko

(10) Patent No.: US 9,044,633 B2
(45) Date of Patent: Jun. 2, 2015

(54) UNDULATING ROPE EXERCISE APPARATUS AND SYSTEM

(71) Applicant: David Pesko, Redondo Beach, CA (US)

(72) Inventor: David Pesko, Redondo Beach, CA (US)

(73) Assignee: David Pesko, Redondo Beach, CA (US)

( * ) Notice: Subject to any disclaimer, the term of this patent is extended or adjusted under 35 U.S.C. 154(b) by 263 days.

(21) Appl. No.: 13/840,316

(22) Filed: Mar. 15, 2013

(65) Prior Publication Data

US 2014/0274612 A1 Sep. 18, 2014

(51) Int. Cl.

| | |
|---|---|
| ***A63B 23/00*** | (2006.01) |
| ***A63B 71/00*** | (2006.01) |
| ***A63B 21/00*** | (2006.01) |

(52) U.S. Cl.

CPC ..... *A63B 21/00163* (2013.04)

(58) Field of Classification Search

CPC ..... A63B 21/1423; A63B 21/1438; A63B 21/143; A63B 22/0076; A61H 1/00; A61H 1/02; A61H 1/0266; A61H 2201/164; A61H 2201/1642; A61H 2205/12

USPC ..... 482/139, 92, 148, 79, 907; 36/132, 136, 36/7.1 R, 7.2, 7.7, 7.5, 114, 122, 11.5; 602/27–30, 23; 128/882, 893; 74/594.6, 594.4; 73/591; 601/23, 601/27–32

See application file for complete search history.

(56) References Cited

U.S. PATENT DOCUMENTS

| | | | | |
|---|---|---|---|---|
| 3,609,888 | A * | 10/1971 | Rickman | 36/7.5 |
| 5,518,486 | A | 5/1996 | Sheeler | |
| 5,545,113 | A * | 8/1996 | Bobich | 482/125 |
| 5,638,614 | A * | 6/1997 | Hardy | 36/113 |
| 5,688,213 | A | 11/1997 | Recker | |
| 5,704,140 | A * | 1/1998 | Fields | 36/132 |
| 2005/0043150 | A1 | 2/2005 | Nitta et al. | |
| 2005/0193588 | A1 * | 9/2005 | Dombowsky | 36/7.5 |
| 2005/0209067 | A1 * | 9/2005 | Backes et al. | 482/91 |
| 2009/0082180 | A1 * | 3/2009 | Castellano | 482/105 |
| 2009/0131233 | A1 * | 5/2009 | Seitzer | 482/105 |

* cited by examiner

*Primary Examiner* — Stephen Crow
*Assistant Examiner* — Megan Anderson
(74) *Attorney, Agent, or Firm* — Blakely Sokoloff Taylor & Zafman LLP

(57) ABSTRACT

An exercise system includes a foot harness and an undulation rope that can be connected to the foot harness. The foot harness includes a back rigid section, two side rigid sections, and a front rigid section. A harness coupling is fixed to at least one of the rigid sections. One or more side straps couple the back rigid section to the two side rigid sections and couple the front rigid section to the two side rigid sections. A bottom strap couples the two side rigid sections. A top strap also couples the two side rigid sections. A dorsal strap may be fixed to the front rigid section and looped over the top strap. One or more of the side and top straps may be adjustable. The undulation rope includes a rope coupling fixed adjacent an end of the rope to provide a detachable connection to the harness coupling.

22 Claims, 8 Drawing Sheets

FIG. 7
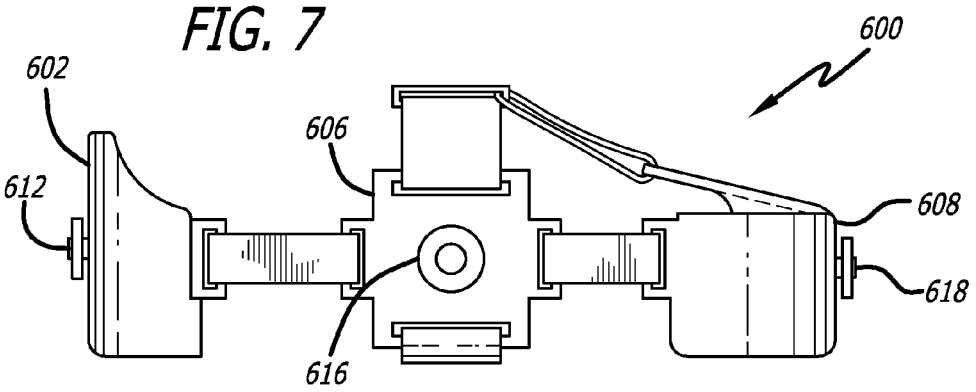
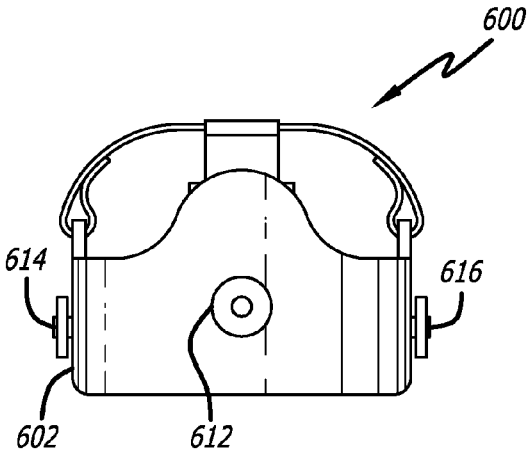
FIG. 8
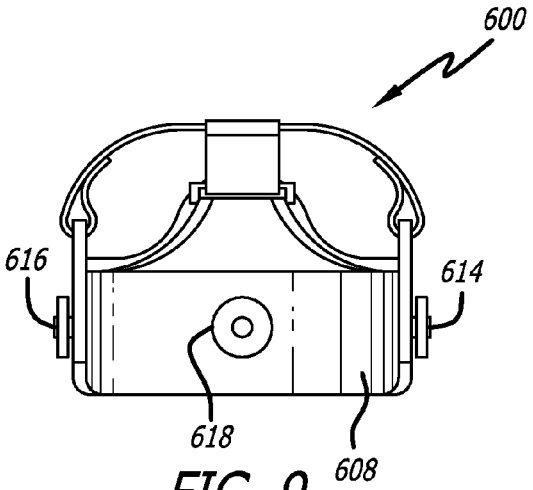
FIG. 9
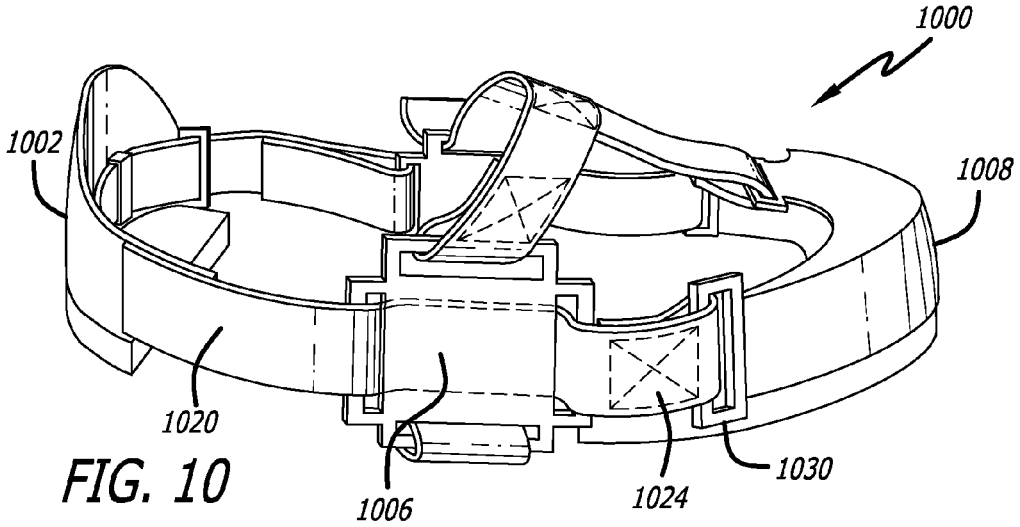
FIG. 10

FIG. 17
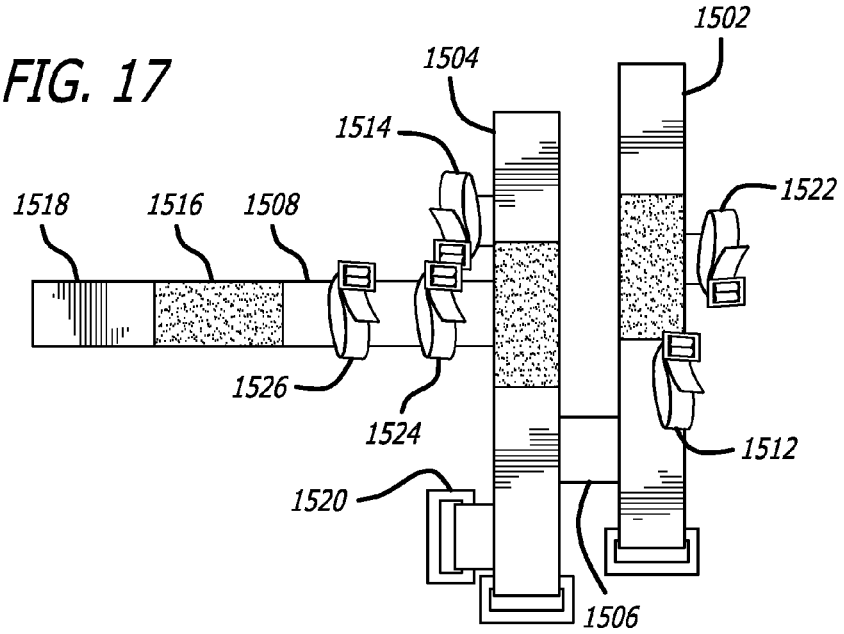
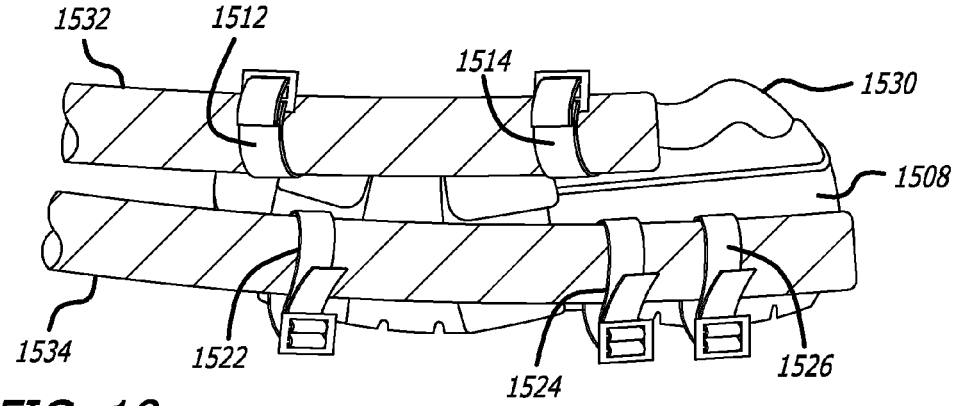
FIG. 18
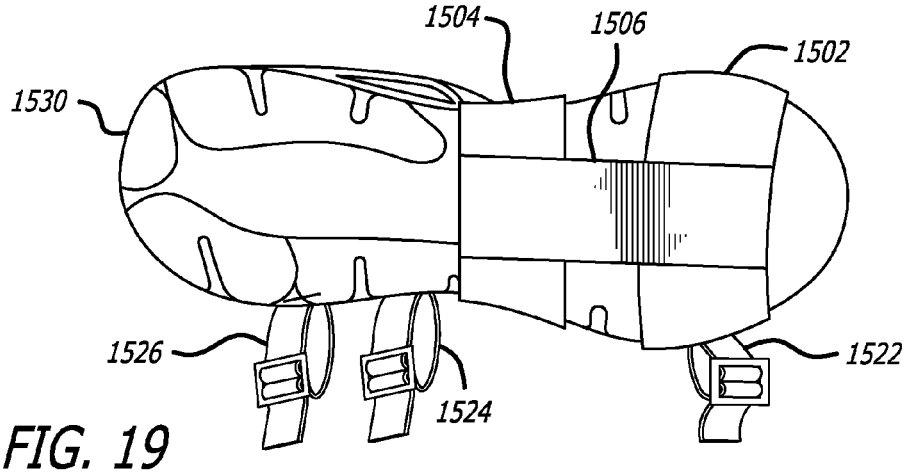
FIG. 19

UNDULATING ROPE EXERCISE APPARATUS AND SYSTEM

CROSS REFERENCE TO RELATED APPLICATIONS

This application claims the benefit pursuant to 35 U.S.C. 119(e) of U.S. Provisional Application No. 61/612,832, filed Mar. 19, 2012, which application is specifically incorporated herein, in its entirety, by reference.

BACKGROUND

1. Field

Embodiments of the invention relate to the field of exercise devices; and more specifically, to a user interface element for an exercise device utilizing inertial force resistance.

2. Background

Rope undulation is an exercise in which lengths of rope are moved to create wavelike motions. The ropes used, which are sometimes referred to as battling ropes, are generally from one to three inches in diameter and ten to thirty feet in length although other sizes may be used depending on the type of exercise being performed. The inertia of the rope provides resistance against which the user works.

Undulating rope exercises typically involve holding a length of rope with each hand and moving the arms to create one or more wavelike motions of the rope. Undulating rope exercises provide cardiovascular benefits and increase strength and endurance of the shoulders, back, abdominals, arms, hips, legs, and hand grip. The simplicity and effectiveness of undulating rope exercises make them ideal for a wide range of users.

One shortcoming of undulating rope exercises is that the user interface to the rope is a hand grip to the end of the rope. Thus the benefits of undulating rope exercises tend to be concentrated in the upper body. Further, the intensity of undulating rope exercises is limited by the grip strength of the user.

It would be desirable to provide a user interface to an undulation rope that permits performance of undulating rope exercises that provide a greater lower body workout. It would also be desirable to provide a user interface to an undulation rope that permits a more intense undulating rope exercise than is otherwise possible based on the grip strength of the user.

SUMMARY

An exercise system includes a foot harness and an undulation rope that can be connected to the foot harness. The foot harness includes a back rigid section, two side rigid sections, and a front rigid section. A harness coupling is fixed to at least one of the rigid sections. One or more side straps couple the back rigid section to the two side rigid sections and couple the front rigid section to the two side rigid sections. A bottom strap couples the two side rigid sections. A top strap also couples the two side rigid sections. A dorsal strap may be fixed to the front rigid section and looped over the top strap. One or more of the side and top straps may be adjustable. The undulation rope includes a rope coupling fixed adjacent an end of the rope to provide a detachable connection to the harness coupling.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements:

FIG. 7 shows a side view of the foot harness of FIG. 6 from the instep side.

FIG. 8 shows a back view of the foot harness of FIG. 6.

FIG. 9 shows a front view of the foot harness of FIG. 6.

FIG. 10 shows a pictorial view of yet another foot harness from the instep side.

FIG. 17 shows a plan view of the foot harness of FIG. 15 laid out flat.

FIG. 18 shows a second pictorial view of the foot harness of FIG. 15.

FIG. 19 shows a bottom view of the foot harness of FIG. 15.

DETAILED DESCRIPTION

In the following description, numerous specific details are set forth. However, it is understood that embodiments of the invention may be practiced without these specific details. In other instances, well-known structures and techniques have not been shown in detail in order not to obscure the understanding of this description.

Figure 1:
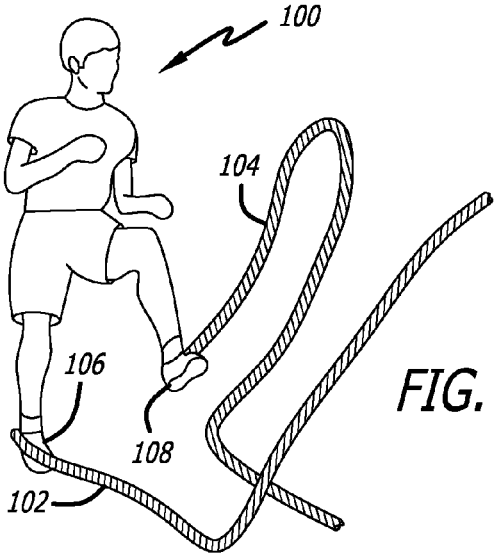
FIG. 1 shows a user with two undulation ropes coupled to the user's feet by a foot harness on each foot.

FIG. 1 shows a user 100 with two undulation ropes 102, 104 coupled to the user's feet 106, 108 by a foot harness on each foot. This allows the user to perform undulating rope exercises that provide a lower body workout.

Figure 2:
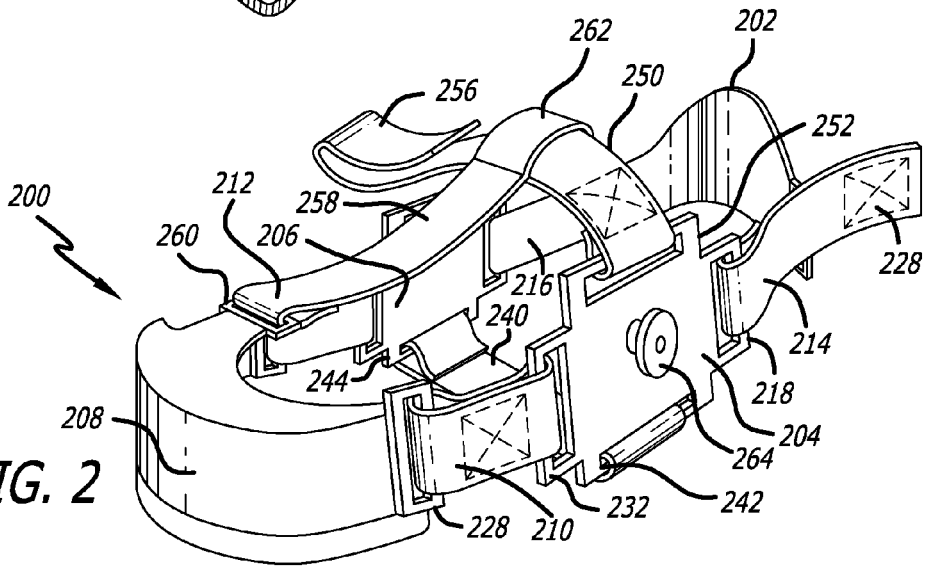
FIG. 2 shows a pictorial view of a foot harness that may be used to couple an undulation rope to the left foot of the user.
Figure 3:
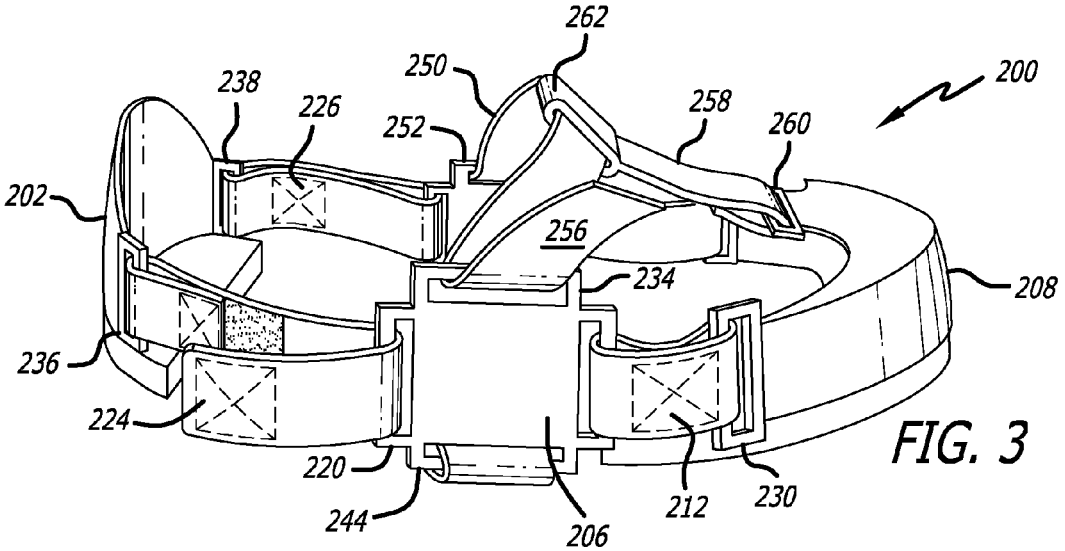
FIG. 3 shows a pictorial view of the foot harness of FIG. 2 from the instep side.

FIG. 2 shows a pictorial view of a foot harness 200 that may be used to couple an undulation rope to the left foot 108 of the user 100. FIG. 3 shows a pictorial view of the same foot harness 200 from the instep side. The foot harness 200 may be worn over an ordinary shoe.

The foot harness 200 has a back (heel) rigid section 202, two side rigid sections 204, 206 and a front (toe) rigid section 208. The four rigid sections may be made of materials such as high strength molded plastic, metal, or other materials that can be fabricated into the necessary shapes and provide the necessary strength. The back rigid section 202 may be shaped to cup a heel of a shoe as shown. The front rigid section 208 may be shaped to surround a toe of a shoe as shown. The four rigid sections may be made from or coated with a rubber-like material to increase the friction against a shoe.

A harness coupling 264 is fixed to one of the four rigid sections. In the embodiment shown in FIG. 2, the harness coupling 264 is fixed to the side rigid section 204 on the outside of the user's foot 108. The harness coupling 264 may be the "male" portion of a ¾" diameter coupling as illustrated. The rope coupling 414 may be mounted approximately 6" from the end of the rope 402. In other embodiments, the harness coupling may be fixed to any of the other rigid sections. More than one harness coupling may be provided in some embodiments and each of the harness couplings is fixed to one of the rigid sections.

Figure 4:
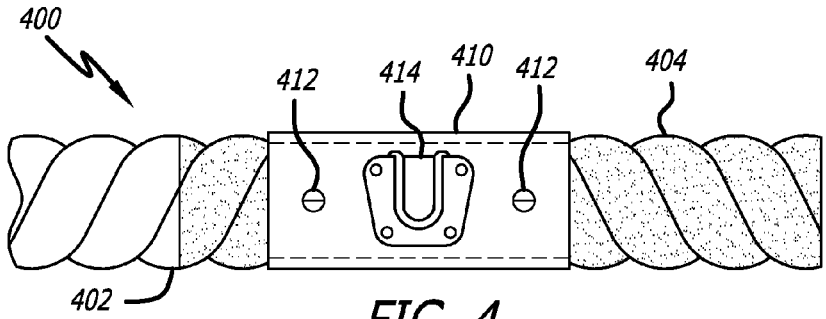
FIG. 4 shows an end portion of an undulation rope that may be used with the foot harness of FIG. 2.

FIG. 4 shows an end portion of an undulation rope 400 that may be used with the foot harness 200. An end of the rope 402 may be treated such as by enclosing the end in a sleeve 404 or applying a coating to hold the end fibers together and improve the manageability of the end of the undulation rope 400. In one embodiment an 18" long rubberized sleeve is applied to the end of the rope 402.

An attachment tube 410 is attached to the end of the rope 402. The attachment tube 410 may be a closely fitting thin metal tube that is slid over the end of the rope 402 and fixed in place by fasteners 412 such as screws or rivets. The fasteners 412 may pass completely through the rope 402 and the attachment tube 410 to securely hold the attachment tube in place on the undulation rope 400.

A rope coupling 414 is fixed to the attachment tube 410. The rope coupling 414 provides a connection to the mating harness coupling 264 on the harness. The rope coupling 414 engages the harness coupling 264 to securely couple the undulation rope 400 to the foot harness 200 which in turn may be securely attached to the user's foot 108. The rope coupling 414 may be the "female" receiving portion of a ¾" diameter coupling as illustrated.

The rope coupling 414 may be mounted approximately 6" from the end of the rope 402. The rope coupling 414 may be mounted on one or both sides of the end of the rope 402. If a rope coupling is mounted on both sides of the rope, the couplings may be provided at substantially diametrically opposed locations on the rope.

In other embodiments the rope coupling 414 may be fixed directly to the rope without an attachment tube. A thru-bolt may fasten the rope coupling 414 to the rope. If two rope couplings 414 are provided, both may be fastened to the rope by the same thru-bolt.

Figure 5:
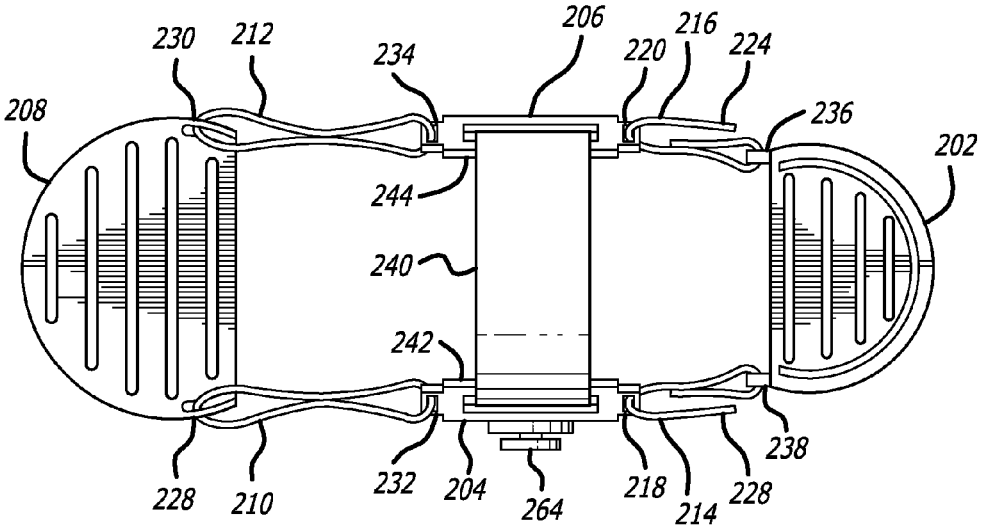
FIG. 5 shows a bottom view of the foot harness.

FIG. 5 shows a bottom view of the foot harness 200 of FIG. 2. Referring to FIGS. 2, 3, and 5, side straps 210, 212 connect the front rigid section 208 to the side rigid sections 204, 206. Additional side straps 214, 216 connect the back rigid section 202 to the side rigid sections 204, 206. While four side straps are illustrated, it will be recognized that some or all of these side straps may be part of a continuous strap such that one, two, or three straps connect the rigid sections 202, 204, 206, 208. The side straps may be nylon webbing, vinyl straps, or other web type material that provides a strong, flexible connection between the four rigid sections.

One or more of the side straps may be adjustable. For example, in the foot harness 200 illustrated the side straps 214, 216 that connect the back rigid section 202 to the side rigid sections 204, 206 pass through a loop 218, 220 in the side rigid sections, are folded back, and are secured by a hook and loop fastener 222, 224, 226, 228. While two of the side straps are shown as being adjustable, other embodiments may provide different numbers of adjustable side straps.

In one embodiment, the side straps 210, 212 that connect the side rigid sections 204, 206 to the front (toe) rigid section 208 are 3" in length, affixed to loops 228, 230 on the toe rigid section and to loops 232, 234 on the side rigid sections and are stitched in place.

The side straps 214, 216 that connect the side rigid sections 204, 206 to the back (heel) rigid section 208 are 5" in length, and are affixed to the loops 236, 238 of the back rigid section and stitched in place. The side straps 214, 216 are made adjustable by being inserted in the loops 218, 220 on each of the side rigid sections 204, 206, folded back, and fastened by hook and loop fasteners 222, 224, 226, 228.

The side rigid sections 204, 206 are further secured by a bottom strap 240 that is affixed to loops 242, 244 on each of the side rigid sections. The side rigid sections 204, 206 are still further secured by a top strap 250 that is affixed to a loop 252 on one of the side rigid sections. The top strap 250 is made adjustable by being inserted in the loop 254 on the other side rigid section, folded back, and fastened by a hook and loop fastener 256. The top strap 250 may be stabilized by a dorsal strap 258 that is fixed to a loop 260 on the front (toe) rigid section 208 and looped over 262 the top strap.

The side rigid sections 204, 206 may be ⅛" thick aluminum, 2" square metal plates surrounded on four sides by fixed loops 1½" wide, made to receive the connecting side straps 210, 212, 214, 216. The bottom strap 240 may be a fixed, stitched 1" wide×4" long strap, located at the bottom arch of the foot harness 200, connecting the lower loops 242, 244 of the side rigid sections 204, 206. The top strap 250 may be an adjustable 1"×6" long strap, located at the top of the foot harness 200, connecting the side rigid sections 204, 206 to each other and passing through a stitched and looped end 262 of the dorsal strap 258, which is connected to the loop 260 of the front rigid section 208.

The harness coupling 264 may be a male portion of a ¾" diameter coupling as illustrated. The harness coupling 264 may be on a 1½"×2" metal reinforced plastic plate that may be riveted to one or more of the rigid sections 202, 204, 206, 208 located on the foot harness 200. The illustrated rope coupling 414 is connected by joining the female clip located on the end of the rope 402, to the male clip located on the foot harness 200 and rotating the couplings into a locking position. The couplings may require rotating the undulation rope 400 by 90 degrees or more from the position of the rope during exercises to allow the couplings to be connected and separated. In one embodiment, the end of the rope has to be directed substantially toward the front (toe) rigid section 208 to separate the couplings. The couplings may allow the undulation rope 400 to rotate freely around an axis that is substantially perpendicular to the rigid section to which the harness coupling 264 is fixed while keeping the rope securely coupled to the harness.

Figure 6:
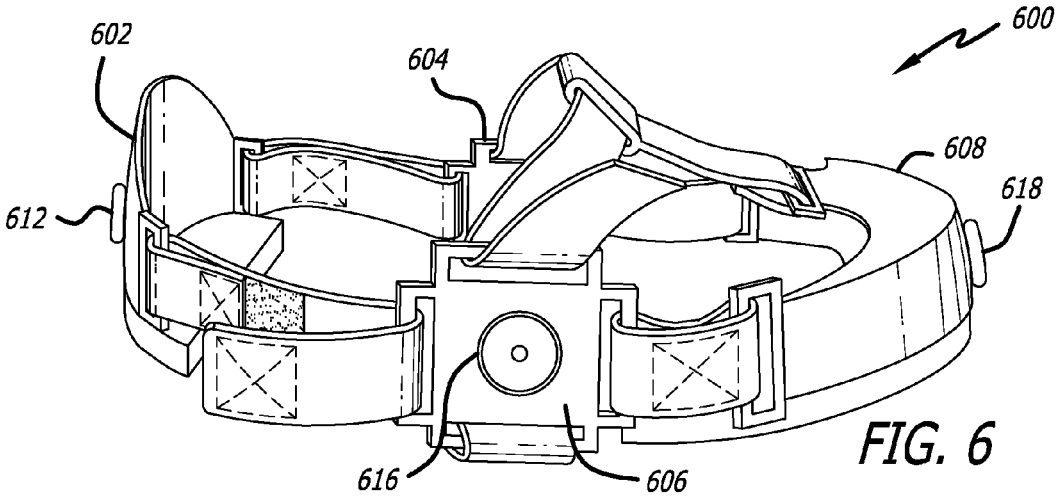
FIG. 6 shows a pictorial view of another foot harness from the instep side.

FIG. 6 shows a pictorial view of another foot harness 600 from the instep side. FIG. 7 shows a side view of the foot harness 600 of FIG. 6 from the instep side. FIG. 8 shows a back view of the foot harness 600 of FIG. 6. FIG. 9 shows a front view of the foot harness 600 of FIG. 6. This embodiment includes a second harness coupling 612 fixed to the back (heel) rigid section 602, a third harness coupling 616 fixed to the instep side rigid section 606 and a fourth harness coupling 618 fixed to the front (toe) rigid section 608. These three additional harness couplings may be in addition to a harness coupling fixed to the outer side rigid section 604. It will be appreciated that a harness may include from one to four harness couplings fixed to a corresponding number of any of the four rigid sections.

FIG. 10 shows a pictorial view of yet another foot harness 1000 from the instep side. This embodiment provides a single side strap 1020 that is fixed to a front (toe) rigid section 1008 on the side not visible in the figure. The side strap 1020 passes through loops in a far side rigid section (not visible), a back (heel) rigid section 1002, a near side rigid section 1006, and through a loop 1030 in the front rigid section 1008. The free end 1024 of the side strap 1020 may include a hook and loop fastener that connects the free end to the side strap after adjustment by the user. Other aspects of this foot harness 1000 may resemble previously described embodiments.

Figure 11:
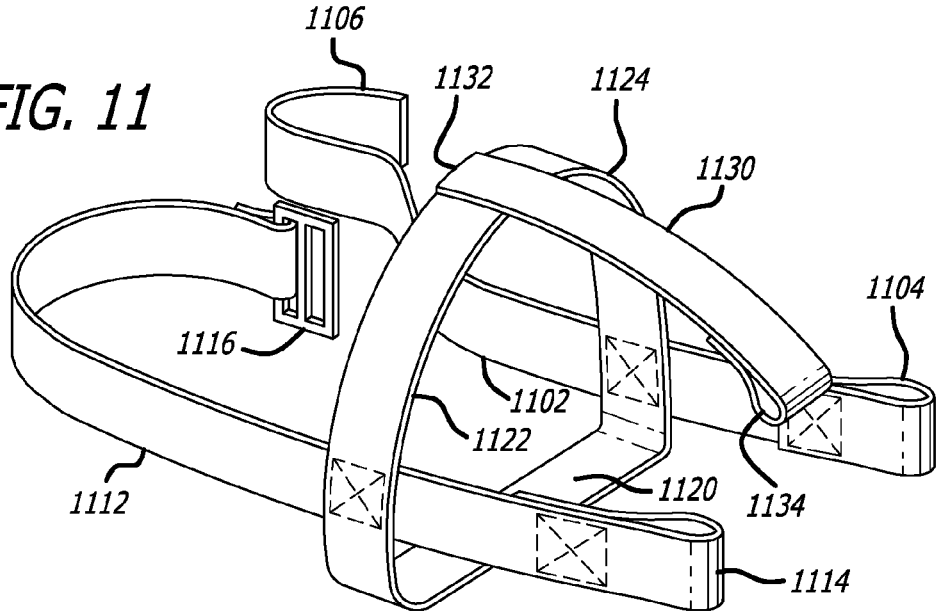
FIG. 11 shows a pictorial view of a strap assembly of still another foot harness without the rigid sections to allow details of the strap assembly to be seen.
Figure 12:
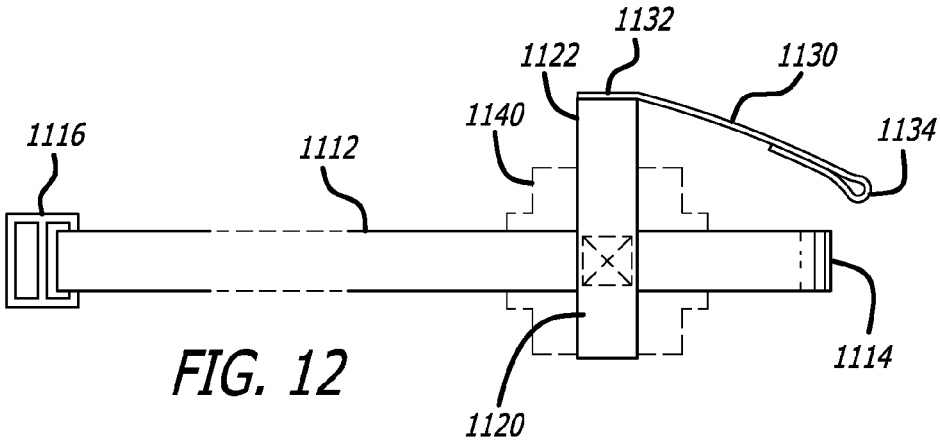
FIG. 12 shows a right side view of the strap assembly of FIG. 11.
Figure 13:
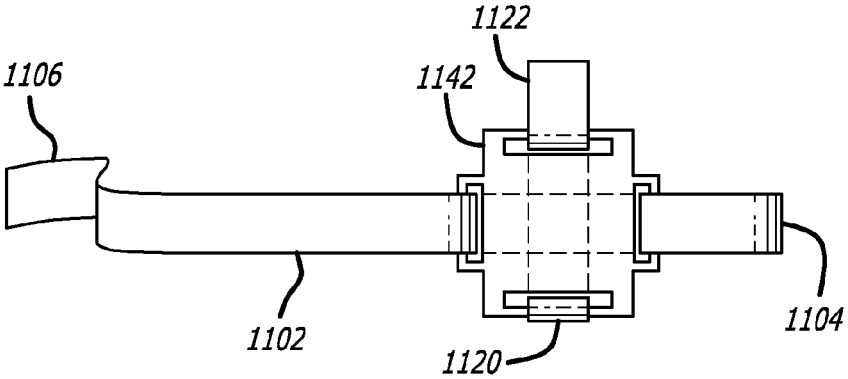
FIG. 13 shows a left side view of the strap assembly of FIG. 11.

FIG. 11 shows a pictorial view of a strap assembly of still another foot harness without the rigid sections to allow details of the strap assembly to be seen. FIG. 12 shows a right side view of the strap assembly of FIG. 11. FIG. 13 shows a left side view of the strap assembly of FIG. 11. A left side strap 1102 is fixed to a front rigid section (not shown) by a loop 1104 formed by doubling over an end of the strap and joining the end to the strap. A right side strap 1112 is similarly fixed to the front rigid section by a second loop 1114.

A buckle 1116 is fixed to a second end of the right side strap 1112. A second end of the left side strap 1102 includes a hook and loop fastener so that the second end of the left side strap can pass through the buckle 1116 to provide an adjustable closure of the two side straps 1102, 1112.

In the embodiment shown, A single strap provides both a bottom strap 1120 and a top strap 1122. The top strap may be in two sections that are joined by a hook and loop fastener 1124 to provide an adjustable closure of the top strap. The top strap 1124 may pass through a loop in a first end 1132 of a dorsal strap 1130. A second end 1134 of the dorsal strap 1130 may be fixed to the front rigid section (not shown) by a loop formed by doubling over the second end of the dorsal strap and joining the second end to the dorsal strap.

As best seen in FIG. 12, the right side strap 1112, the top strap 1122, and the bottom strap 1120 pass through four loops in a right side rigid section 1140. As best seen in FIG. 13, the left side strap 1102, the top strap 1122, and the bottom strap 1120 similarly pass through four loops in a left side rigid section 1142. As previously discussed, harness couplers may be fixed to the side rigid sections.

Figure 14:
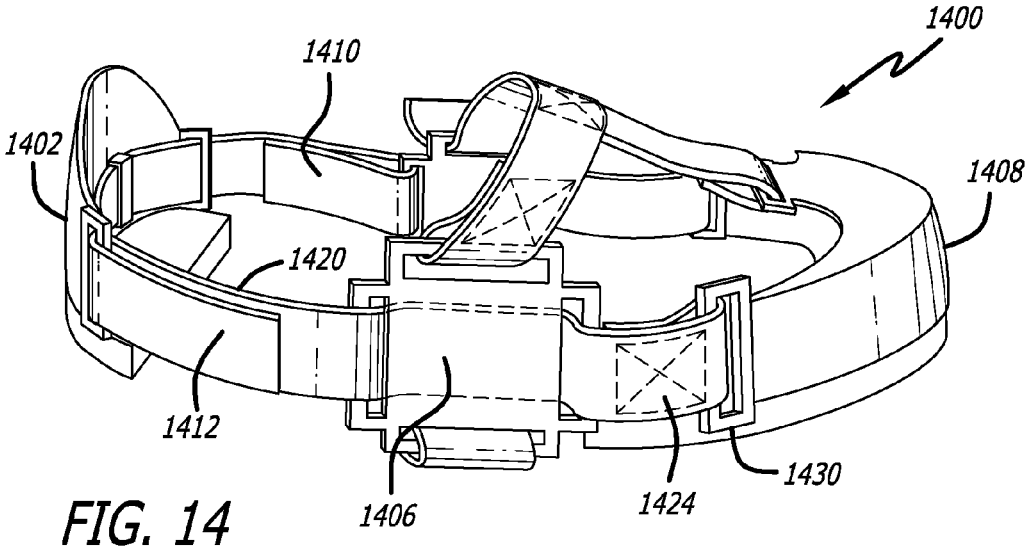
FIG. 14 shows a pictorial view of yet another foot harness from the instep side.

FIG. 14 shows a pictorial view of yet another foot harness 1400 from the instep side. This embodiment provides two side straps 1410, 1420. A first side strap 1410 is fixed to a front (toe) rigid section 1408 on the side not visible in the figure. The first side strap 1410 passes through loops in a far side rigid section (not visible) and a back (heel) rigid section 1402. A second side strap 1420 is fixed 1424 to a loop 1430 in the front rigid section 1408 and passes through a near side rigid section 1406. The free end 1412 of the first side strap 1410 may include a hook and loop fastener that connects to the free end of the second side strap 1420 after adjustment by the user. Other aspects of this foot harness 1400 may resemble previously described embodiments.

Figure 15:
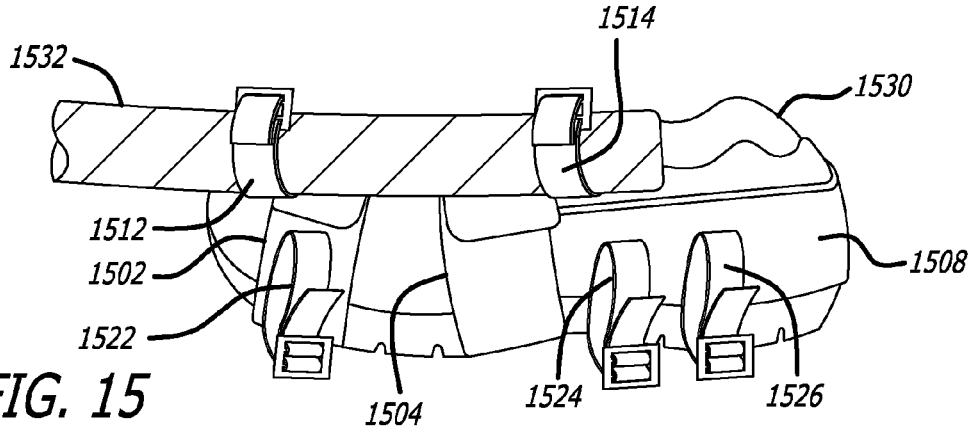
FIG. 15 shows a pictorial view of yet another foot harness.

FIG. 15 shows a pictorial view of yet another foot harness. This embodiment provides a foot harness that includes straps as the coupler for the rope. The straps may provide a more secure connection between the foot harness and the rope that may be needed for more intense exercises or when larger ropes are used. The harness may be worn over a shoe 1530. The harness may include two circumferential straps 1502, 1504 that go around the front part of the foot and are closed by hook and loop fasteners. Rope connectors 1512, 1514 may be coupled to the circumferential straps 1502, 1504. The rope connectors 1512, 1514 go around the end of a rope 1532 and are closed by hook and loop fasteners.

Figure 16:
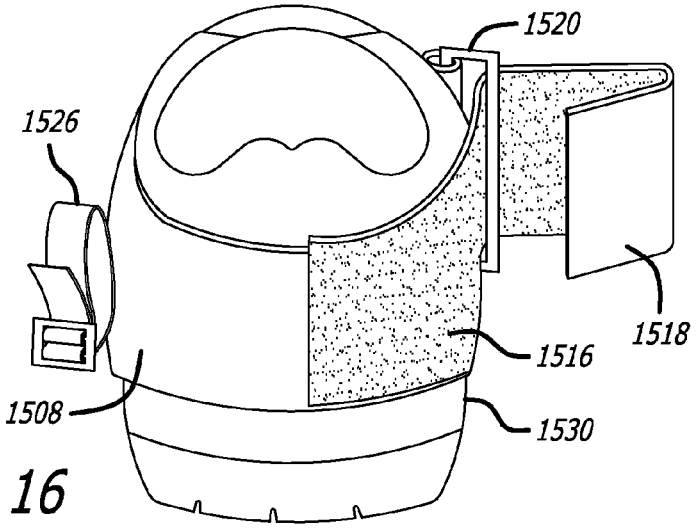
FIG. 16 shows a rear view of the foot harness of FIG. 15.

FIG. 16 shows a rear view of the foot harness of FIG. 15. FIG. 17 shows a plan view of the foot harness of FIG. 15 laid out flat. A first end of a side strap 1508 may be fixed to a circumferential strap 1504. The second end 1518 of the side strap 1508 may include a hook and loop fastener. The second end 1518 may be passed around the heel of the user and through a loop 1520 fixed to the circumferential strap 1504 to provide a secure attachment to the user's foot.

FIG. 18 shows a second pictorial view of the foot harness of FIG. 15. A second set of rope connectors 1522, 1524, 1526 may be coupled to the circumferential straps 1502 and/or the side strap 1508. While the figure shows two ropes 1532, 1534 secured to the foot harness, it will be appreciated that a harness that provides two sets of rope connectors may be used with one rope as well as with two. Two sets of rope connectors may be provide to accommodate two sizes of rope and/or two connection positions on the foot for use in different exercises.

FIG. 19 shows a bottom view of the foot harness of FIG. 15. A stabilizer strap 1506 may be fixed to the two circumferential straps 1502, 1504. The stabilizer strap 1506 may be located along the bottom of the foot as shown or along the top or side of the foot. In other embodiments (not shown) more than one stabilizer strap may be fixed to the circumferential straps.

Figure 20:
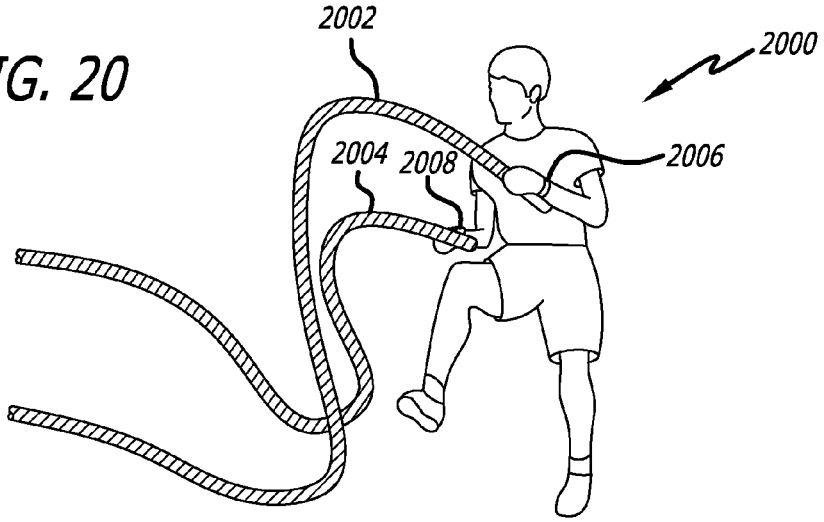
FIG. 20 shows a user with two undulation ropes held in the user's hands and supported in each hand by a hand strap.

FIG. 20 shows a user 2000 with two undulation ropes 2002, 2004 held in the user's hands and supported in each hand by a hand strap 2006, 2008. This may allow the user to perform more intense undulating rope exercises that provide an upper body workout than would be possible if the ropes were held in the hand without support.

Figure 21:
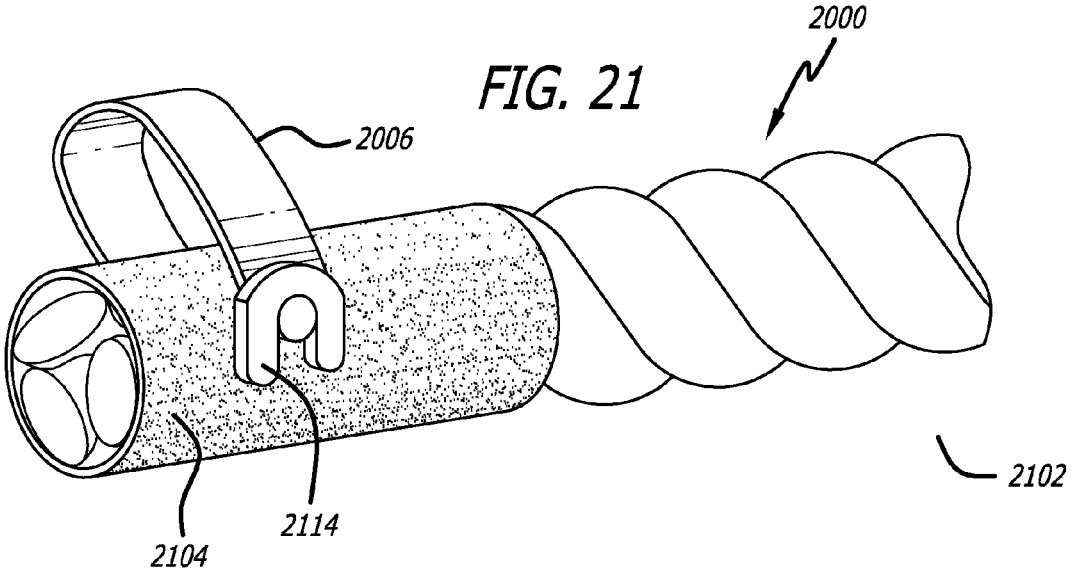
FIG. 21 shows an end portion of the undulation rope that provides a hand strap.
Figure 22:
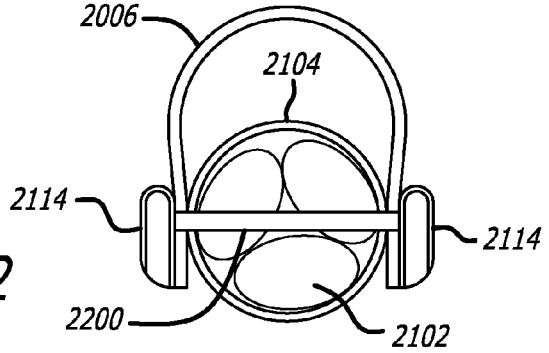
FIG. 22 shows a section view of the end portion of the undulation rope of FIG. 21.

FIG. 21 shows an end portion 2102 of the undulation rope 2002 that provides a hand strap 2006. FIG. 22 shows a section view of the end portion 2102 of the undulation rope 2002 taken through the axis of a fastener 2200 that couples rope connectors 2114 and the hand strap 2006 to an end of the rope 2102. The hand strap 2006 may be a 9" long×1" wide rubber strap that loops to connect both rope connectors 2114. The hand strap 2006 may provide support to the forearm of the user when the rope is held and grabbed during exercise.

The end of the rope 2102 may be treated such as by enclosing the end in a sleeve 2104 or applying a coating to hold the end fibers together and improve the manageability of the end of the undulation rope 2002. In one embodiment an 18" long rubberized sleeve is applied to the end of the rope 2102.

In another embodiment (not shown), a fastener couples rope connectors 2114 to an end of the rope 2102. The hand strap includes a connector on each end of the hand strap that can be coupled to the rope connectors 2114 when it is desired to have a hand strap on the rope.

Figure 23:
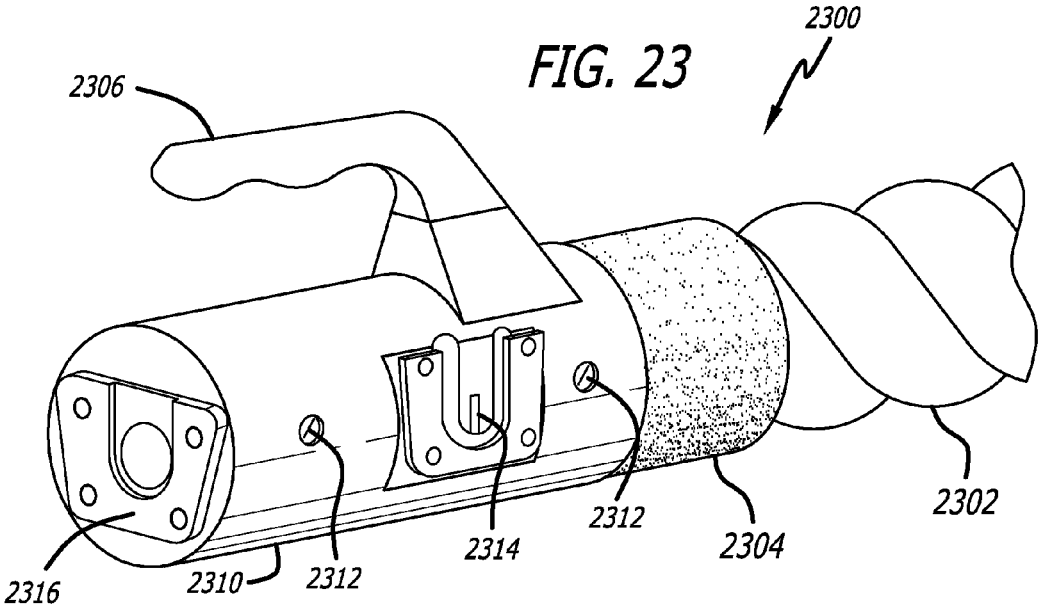
FIG. 23 shows a pictorial view of another end portion of an undulation rope that includes a hand grip.
Figure 24:
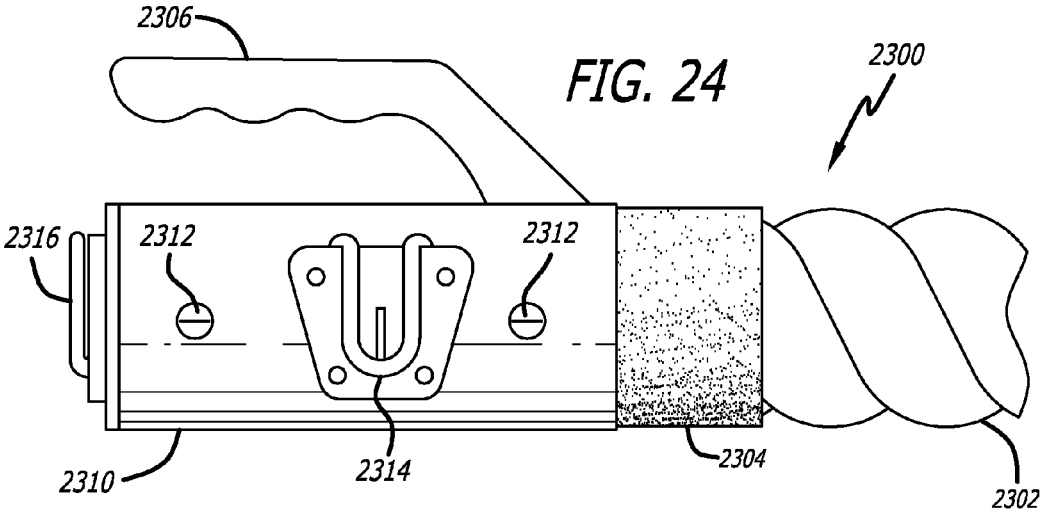
FIG. 24 shows a side view of the end portion of the undulation rope of FIG. 23.
Figure 25:
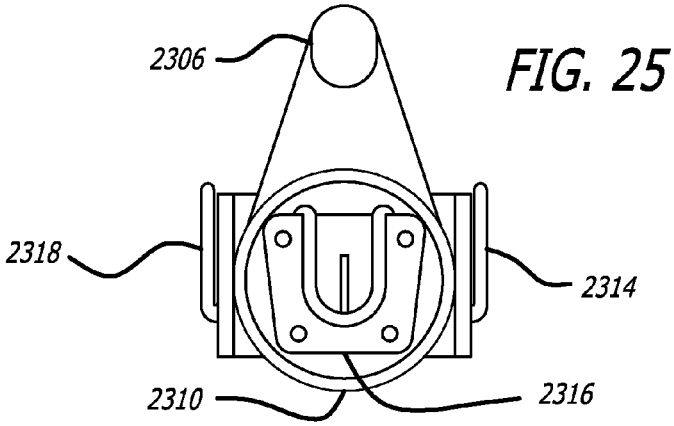
FIG. 25 shows an view of the undulation rope of FIG. 23.

FIG. 23 shows a pictorial view of another end portion of an undulation rope 2300 that includes a hand grip 2306. FIG. 24 shows a side view of the end portion of the undulation rope 2300 of FIG. 23. FIG. 25 shows an view of the undulation rope 2300 of FIG. 23.

An end of the rope 2302 may be treated such as by enclosing the end in a sleeve 2304 or applying a coating to hold the end fibers together and improve the manageability of the end of the undulation rope 2300. An attachment tube 2310 is attached to the end of the rope 2302. The attachment tube 2310 may be a closely fitting thin metal tube that is slid over the end of the rope 2302 and fixed in place by fasteners 2312 such as screws or rivets. The fasteners 2312 may pass completely through the rope 2302 and the attachment tube 2310 to securely hold the attachment tube in place on the undulation rope 2300.

One or more rope couplings 2314, 2316, 2318 are fixed to the attachment tube 2310. The rope couplings 2314, 2316, 2318 provide a connection to the mating harness coupling 264 on a harness or hand strap as previously described. While three rope couplings 2314, 2316, 2318 are shown and described, it will be appreciated that one, two, or three rope couplings may be provided in various embodiments.

A handle 2306 may be fixed to the attachment tube 2310. The handle 2306 may provide a better grip for use with larger diameter ropes and/or a more secure grip for ropes of any size.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A foot harness for an exercise system, the foot harness comprising:

a back rigid section that receives a heel of a foot;

two side rigid sections;

a front rigid section that receives a toe of the foot;

wherein each of the rigid sections is independent of the remaining rigid sections;

a harness coupling fixed to one of the rigid sections, the harness coupling providing a connection for a rope coupling fixed to an undulation rope;

one or more side straps that couple the back rigid section to the two side rigid sections and couple the front rigid section to the two side rigid sections;

a bottom strap that couples the two side rigid sections; and a top strap that couples the two side rigid sections.

2. The foot harness of claim 1 further comprising a dorsal strap fixed to the front rigid section and looped over the top strap.

3. The foot harness of claim 1 wherein one or more of the side straps are adjustable.

4. The foot harness of claim 1 wherein the top strap is adjustable.

5. The foot harness of claim 1 wherein the harness coupling and the rope coupling connect to allow the undulation rope to rotate freely around an axis that is substantially perpendicular to the rigid section to which the harness coupling is fixed while keeping the undulation rope securely coupled to the harness.

6. The foot harness of claim 1 wherein the harness coupling and the rope coupling require that the undulation rope be rotated at least 90 degrees from the position of the undulation rope during exercises to allow the harness coupling and the rope coupling to be separated.

7. The foot harness of claim 1 wherein the foot is enclosed in a shoe, the back rigid section receives the heel of the foot by receiving a heel of the shoe, and the front rigid section receives the toe of the foot by receiving a toe of the shoe.

8. A method of exercising comprising:

attaching a foot harness to a foot, the foot harness including a back rigid section that receives a heel of the foot, two side rigid sections, a front rigid section that receives a toe of the foot, wherein each of the rigid sections is independent of the remaining rigid sections;

a harness coupling fixed to one of the rigid sections, one or more side straps that couple the back rigid section to the two side rigid sections and couple the front rigid section to the two side rigid sections, a bottom strap that couples the two side rigid sections, and a top strap that couples the two side rigid sections;

detachably connecting a rope coupling fixed adjacent an end of an undulation rope to the harness coupling on the foot harness;

and moving the foot to create a wavelike motion of the undulation rope.

9. The method of exercising of claim 8 wherein the foot harness further includes a dorsal strap fixed to the front rigid section and looped over the top strap.

10. The method of exercising of claim 8 wherein attaching the foot harness further comprises adjust one or more of the side straps.

11. The method of exercising of claim 8 wherein attaching the foot harness further comprises adjusting the top strap.

12. The method of exercising of claim 8 wherein detachably connecting the rope coupling further comprises rotating the undulation rope at least 90 degrees from the position of the undulation rope during exercises to allow the harness coupling and the rope coupling to be connected.

13. The method of exercising of claim 8 wherein attaching the foot harness to the foot further comprises wearing a shoe on the foot, receiving a hell of the shoe with the heel of the foot in the back rigid section, and receiving a toe of the shoe with the toe of the foot in the front rigid section.

14. An exercise system comprising:

a foot harness including a back rigid section that receives a heel of a foot, two side rigid sections, a front rigid section that receives a toe of the foot, wherein each of the rigid sections is independent of the remaining rigid sections;

a harness coupling fixed to one of the rigid sections, one or more side straps that couple the back rigid section to the two side rigid sections and couple the front rigid section to the two side rigid sections, a bottom strap that couples the two side rigid sections, and a top strap that couples the two side rigid sections;

an undulation rope including a rope coupling fixed adjacent an end of the undulation rope to provide a detachable connection to the harness coupling.

15. The exercise system of claim 14 wherein the foot harness further includes a dorsal strap fixed to the front rigid section and looped over the top strap.

16. The exercise system of claim 14 wherein one or more of the side straps are adjustable.

17. The exercise system of claim 14 wherein the top strap is adjustable.

18. The exercise system of claim 14 wherein the harness coupling and the rope coupling connect to allow the undulation rope to rotate freely around an axis that is substantially perpendicular to the rigid section to which the harness coupling is fixed while keeping the undulation rope securely coupled to the harness.

19. The exercise system of claim 14 wherein the harness coupling and the rope coupling require that the undulation rope be rotated at least 90 degrees from the position of the undulation rope during exercises to allow the harness coupling and the rope coupling to be separated.

20. The exercise system of claim 14 wherein the undulation rope further includes an attachment tube attached to the end of the undulation rope and the rope coupling is fixed to the attachment tube.

21. The exercise system of claim 14 wherein the undulation rope further includes a hand grip.

22. The exercise system of claim 14 wherein the foot is enclosed in a shoe, the back rigid section receives the heel of the foot by receiving a heel of the shoe, and the front rigid section receives the toe of the foot by receiving a toe of the shoe.

* * * * *